US006668411B1

(12) United States Patent
Anderberg

(10) Patent No.: US 6,668,411 B1
(45) Date of Patent: Dec. 30, 2003

(54) MOBILE ELEVATING GANGWAY FOR PASSENGERS

(75) Inventor: Nils-Eric Anderberg, Trelleborg (SE)

(73) Assignee: FMT International Trade AB (SE)

( * ) Notice: Subject to any disclaimer, the term of this patent is extended or adjusted under 35 U.S.C. 154(b) by 0 days.

(21) Appl. No.: 09/621,250

(22) Filed: Jul. 21, 2000

Related U.S. Application Data

(60) Provisional application No. 60/145,300, filed on Jul. 23, 1999.

(51) Int. Cl.[7] ..... E01D 15/24

(52) U.S. Cl. ..... 14/69.5; 14/2.4

(58) Field of Search ..... 14/72.5, 69.5, 14/2.4, 70, 71.1, 71.3, 71.5; 296/179

(56) References Cited

U.S. PATENT DOCUMENTS 1,106,074 A * 8/1914 Bidlake ..... 14/72.5
2,362,170 A * 11/1944 Swaisgood ..... 182/1
2,778,674 A * 1/1957 Attendu ..... 14/72.5
3,019,917 A * 2/1962 Ajero ..... 14/72.5
3,964,118 A * 6/1976 Meyers et al. ..... 14/72.5
4,457,554 A * 7/1984 Fuisz et al. ..... 296/179
6,212,724 B1 * 4/2001 Zhou ..... 14/71.5

FOREIGN PATENT DOCUMENTS

GB 2111449 A * 7/1983 ..... 14/72.5

* cited by examiner

*Primary Examiner*—Thomas B. Will
*Assistant Examiner*—Meredith Petravick
(74) *Attorney, Agent, or Firm*—Orum & Roth

(57) ABSTRACT

A passenger bridge for facilitating passengers boarding and disembarking a ship includes a first gangway section adjustably suspended within and partly enclosed by a frame of the bridge and sets of wheels for supporting the frame body and to provide maneuverability of the bridge in all directions along the quay.

10 Claims, 4 Drawing Sheets

MOBILE ELEVATING GANGWAY FOR PASSENGERS

This application claims the benefit of U.S. Provisional Application No. 60/145,300, filed Jul. 23, 1999.

TECHNICAL FIELD OF THE INVENTION

The present invention relates to a bridge device of the type defined in the appended claims 1 for passengers boarding and disembarking e.g. a ship.

BACKGROUND ART

When passengers disembark or enter cruise ships in different harbors a gangway is used to make the passage of people convenient. There are many issues that must be considered by the manufacturer of the gangway such as good accessibility for wheelchairs and possible emergency situations.

Gangways today often consist of installations shown in FIGS. 1 and 2. These installations show how gangway lengths of between 35–60 m are used to connect the arrival terminal with the cruise ship. As there are often differences in the height between the quay and the door of the ship, one end of the gangway can be adjusted vertically. Certain gangways are fixedly installed on the quay. This results in that the docking and of the ship and the connection to the gangway often is time consuming and difficult. Other gangways are often installed on rails to allow adjustment of the gangway in the longitudinal direction of the ship when the ship docks in different positions.

These passenger gangways are very limited in terms of the type of ships that can dock at different installations. They take up a large space and make it difficult for other activities to occur on the quay area around the installation.

SUMMARY OF THE INVENTION

It is the object of the invention to provide an improved gangway bridge compared to prior art of the type mentioned by way of introduction.

Another object of the invention is to provide a gangway bridge that can be used for many different types of ships and passenger terminals. Other objects of the invention will be obvious from the following description.

These and other objects are achieved by a bridge device as defined by the independent claim 1. The dependent claims state particularly preferred embodiments of the invention.

The invention is based on a bridge device for passengers boarding and disembarking e.g. a ship comprising a frame body which defines an essentially cuboid space, a first gangway section which is adjustably suspended within and partly enclosed by the frame body, and sets of wheels arranged to support the frame body and to allow maneuverability in all directions along the quay. This bridge device allows the ship to dock in the near vicinity of the passenger terminal and still be connected via the bridge device to the passenger terminal. The maneuverability of the bridge device also allows the bridge device to be moved between different terminals and even away from the quay when not in use.

The bridge device preferably has at least a second and third gangway section which are adjustably suspended within and partly enclosed by the frame body in essentially parallel, vertical planes with a vertical plane of the first gangway section. The gangway sections are interconnected through middle gangway sections which are arranged at essentially right angles to and at opposite ends of the parallel gangway sections. Arranging the gangway sections in this manner results in a compact design of the mobile gangway in relation to prior art gangways.

Each gangway section is preferably vertically and individually adjustable. This gives the mobile gangway great flexibility in adjusting the gangway for different ships, water levels, piers and passenger terminals. Being able to adjust the gangway sections vertically results in the mobile bridge device being flexible and efficient when used for passengers boarding and/or disembarking e.g. a ship.

At least one of the gangway sections has advantageously an inner gangway section that is telescopically arranged within the gangway section. The telescopic function of the inner gangway section makes it possible for the mobile gangway to be connected to the door of a ship without getting too close to the edge of the quay or to the terminal without getting to close to the terminal.

BRIEF DESCRIPTION OF THE DRAWINGS

The invention will now be described through an explanatory example of the preferred embodiment of the invention.

DESCRIPTION OF PREFERRED EMBODIMENTS OF THE INVENTION

Figure 1:
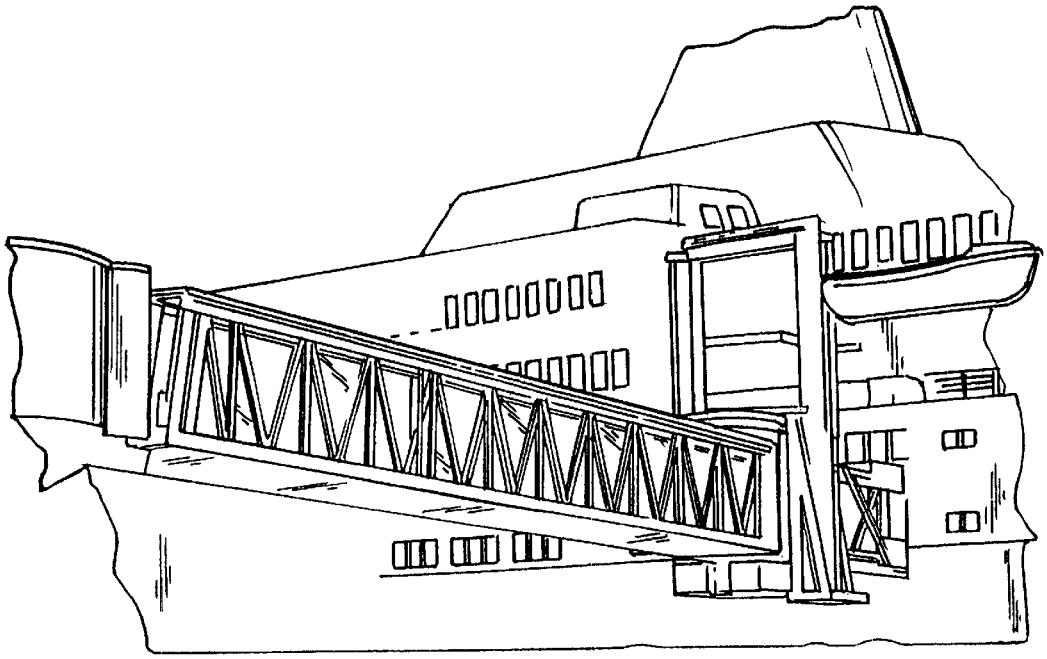
Fig. 1 PRIOR ART
FIGS. 1 and 2 show gangways according to prior art.
Figure 2:
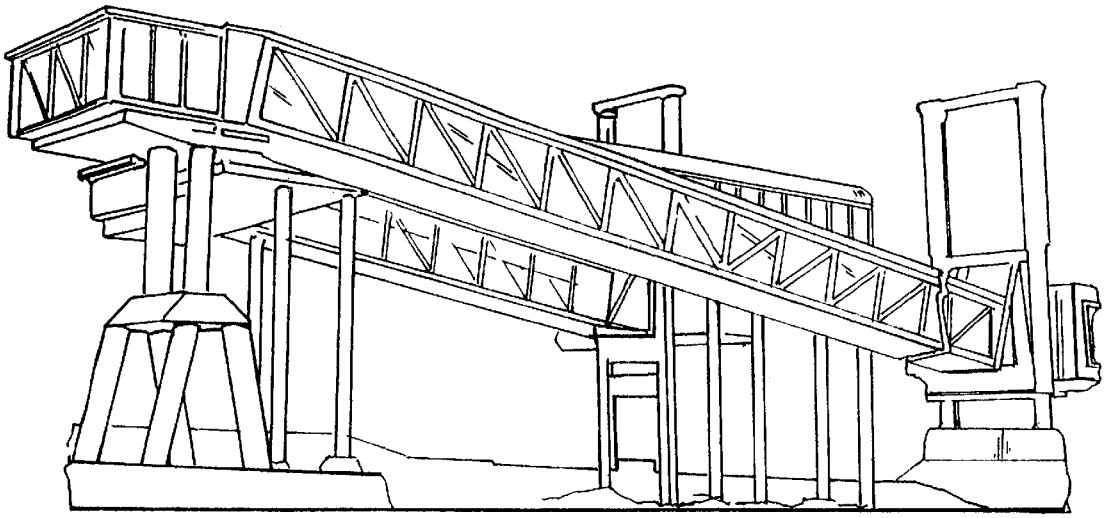
Fig. 2 PRIOR ART
Figure 3:
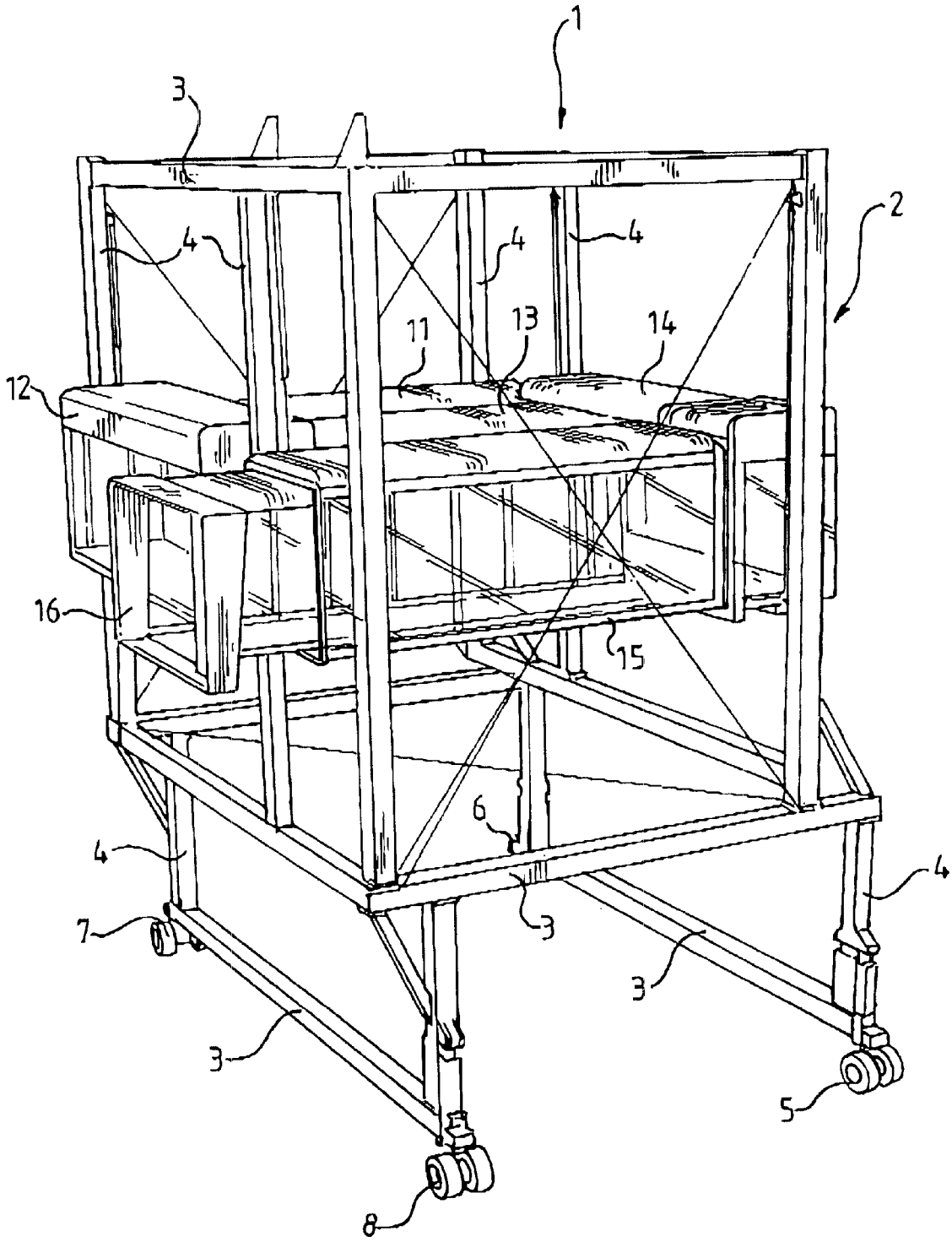
FIGS. 3 and 4 show elevated views of the bridge according to a first embodiment of the invention.
Figure 4:
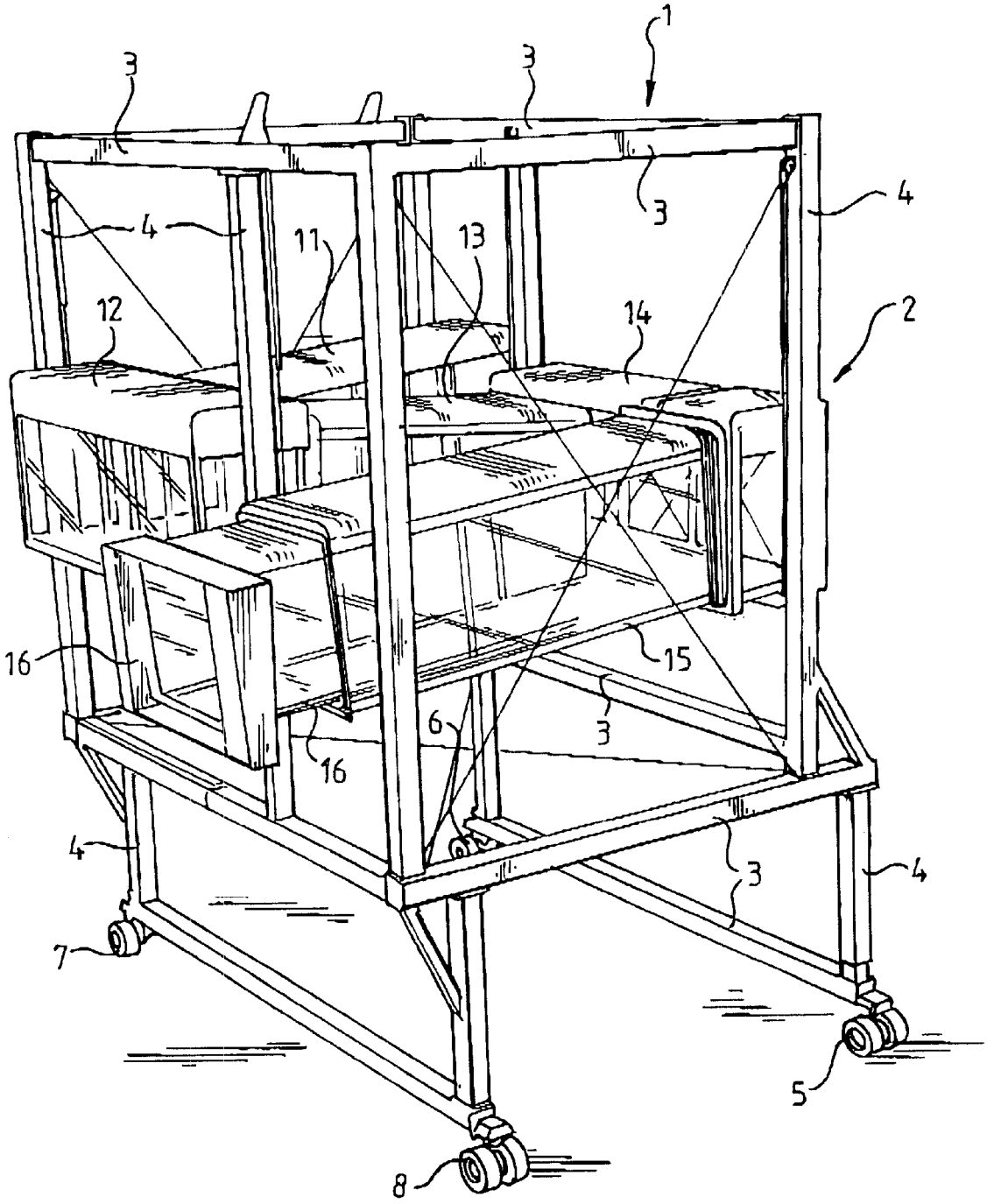

In FIGS. 3 and 4 a mobile elevating gangway bridge according to the invention is shown. The mobile elevating gangway bridge is weather protected for convenient boarding and disembarking of passengers from a passenger ship. The gangway bridge is mobile and can be driven between different exits along the terminal pier. The gangway bridge 1 consists of a steel frame 2 with beams defining the boundaries of the body. The steel frame body 2 has essentially the shape of a rectangular prism or preferably a cube. Both horizontal 3 and vertical 4 beams make up the steel frame 2. The height of the steel frame body 2 can be as high as about 20 m above the ground, preferably about 16–17 m. The frame body 2 can, of course, be tailored according to the different conditions that apply at different harbors. Such an adjustment has been made in FIGS. 3 and 4 where part of the frame body is offset in relation to the wheels 5, 6, 7 and 8 of the gangway 1, which allows for free maneuverability in this embodiment.

Gangways 11, 12, 13, 14, 15 and 16 are suspended within the frame body 2 and are hydraulically controlled to allow vertical adjustment in relation to different ships, water levels and passenger halls. The hydraulic system meets the standards in SAE & ASME. As the total length of the gangway 11–16 normally is between about 40–55 m, the gangway can be arranged with one, two or preferably three essentially parallelgangway sections arranged within the frame body. This minimizes the size of the frame body 2 in one direction and makes the frame body 2 more square in the horizontal plane. The compact shape of the frame 2 allows for good maneuverability and achieves the required vertical inclination of the gangway sections without taking up the whole length of the quay.

In FIG. 3 all the gangway sections 11–16 are suspended at a horizontal level.

Preferably, the gangway includes three essentially parallel long gangway sections 11, 13 and 15. These gangway sections are suspended in essentially parallel, vertical planes. The gangway sections can be suspended through cables or ledges in the frame body as would appear the most convenient for the person skilled in the art. As is shown in FIG. 4 the incline/decline of the gangway sections 11, 13 and 15 can be adjusted from a horizontal level to a maximum angle of 1:12, that is one-meter incline/decline on every twelve meters of gangway. The uneven number of three gangway sections 11–15, in this embodiment are interconnected through two shorter horizontal middle gangway sections 12, 14, which can be adjusted vertically while in their longitudinal direction maintaining an essentially horizontal position. The shorter middle gangway sections 12, 14 are also preferably parallel to each other and at right angles to the longer gangway sections 11, 13, 15. There is one short middle section 12, 14 less than there are long inclined/declined gangway sections 11, 13, 15. The first middle gangway section 12 is arranged to interconnect the first and second gangway section 11, 13. The second middle gangway section 14 is arranged to interconnect the second and third gangway section 13,15. This allows the two openings of the gangway to be located at opposite sides of the frame body.

Figure 5:
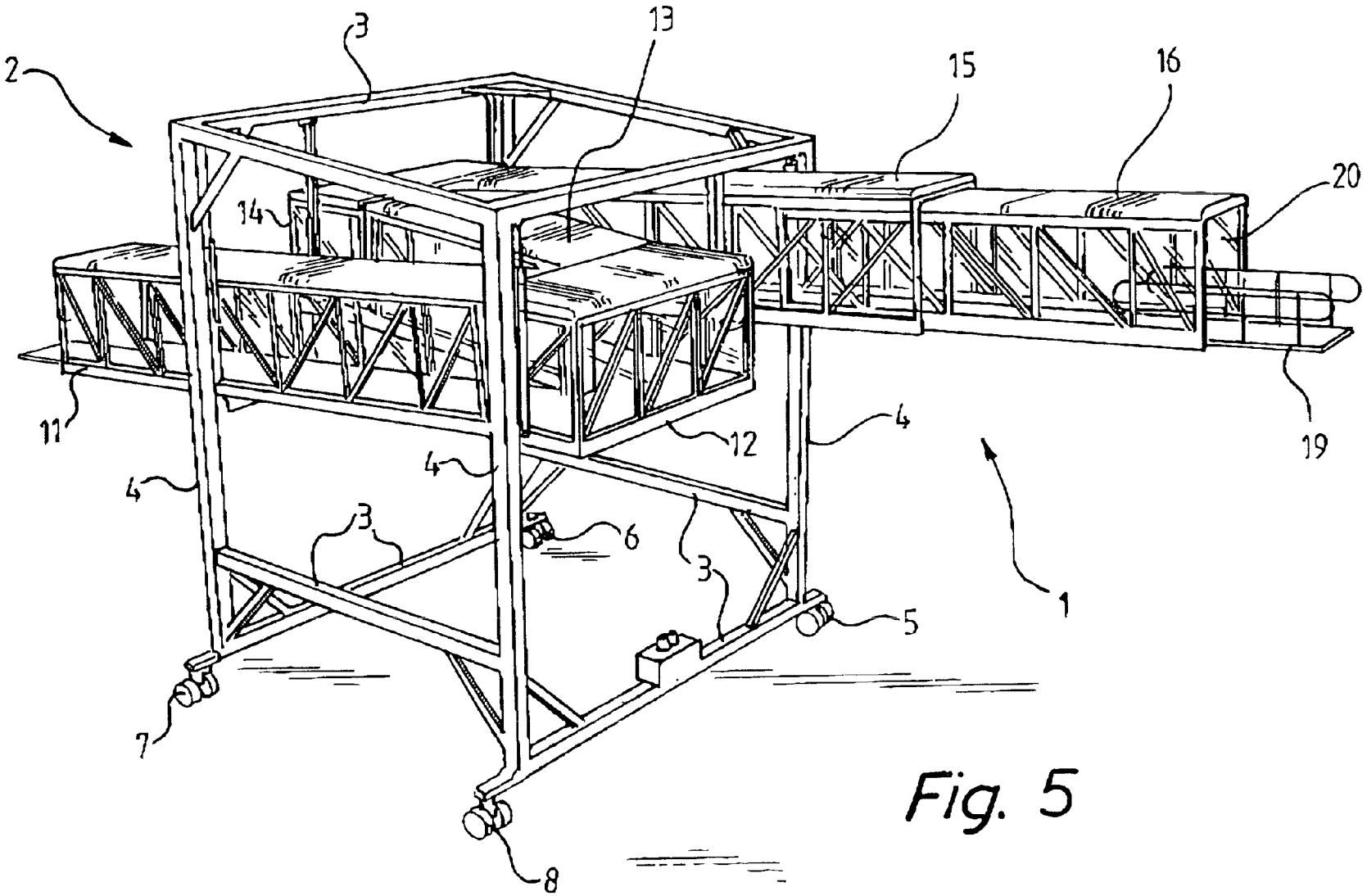
FIG. 5 shows an elevated view of the bridge according to a second embodiment of the invention.

To further minimize the size of the passenger bridge 1 when it is not in use and increase the flexibility of adapting to different ships the first 11 and third 15 gangway sections can be made telescopic. This is shown in FIG. 5 through the second embodiment of the passenger bridge 1 where the third gangway section 15 is made telescopic. The same reference numbers are used for the same components in the first embodiment (FIGS. 3 & 4) and the second embodiment (FIG. 5). The length of each telescopic gangway section 16 is only limited by the length of the gangway section 15 that it moves within and how much it is allowed to protrude from the steel frame body 2. The telescopic gangway sections 16 may have telescopic movement with speeds of approximately 3 m/min. A walkway 17, 19 may also be arranged at the end of each opening 18, 20 in the gangways 11, 16.

The passenger bridge 1 should allow for connection to ship doors that are as high as about 8–12 m above the quay. The passenger bridge 1 should also allow for connection to a passenger hall that is at a height of about 9 m above the quay. The vertical adjustment of the gangway sections 11–15 are performed by vertically raising or lowering the middle gangway sections 12, 14 or the longer sections 11, 13, 15 using hydraulic power in the form of hydraulic jacks (with a capacity of 25 tons). The connections between the three longer parallel gangway sections 11, 13, 15 and the shorter middle gangway sections 12, 14 allow through an accordion connection for the raising and lowering of the gangway sections 11–15. The gangway sections can be adjusted vertically with a speed of about 1.5 m/min.

Sensors (not shown) are arranged at each gangway section 11–16 to indicate the incline/decline of the gangway sections 11–16 in relation to the horizontal level. The sensors are connected to a control unit (not shown) for controlling the gangway sections 11–16. The control unit is based on PLC technology. The control unit is self-diagnostic.

An operator's LCD display with control panel is located in the gangway section facing the ship, displaying relevant information, including current status and alarms in plain text to the operator and/or service personnel. The control unit can be connected via a modem and a mobile phone to remotely located service personnel who can perform remote diagnostics on the mobile gangway. The control unit stores the last 100 alarms and thereby helps the operator and service personnel to see trends, and rectify possible incidents before resulting in accidents. Limit switches stop the movement of the gangway sections 11–16 when outer limits of raising, lowering, extending and retracting the gangway sections have been reached. The control panel will basically have push buttons and maneuvering devices at least according to the following functions:

- Maneuvering control for elevating and lowering the gangway sections 11–15.
- Controls for extending and retracting the telescopic gangway sections 16.
- Controls for lateral movement and steering of the mobile gangway bridge.
- Emergency stop button for stopping all gangway movements.

The frame body 2 is preferably suspended on four sets of wheels 5, 6, 7 and 8. One of the four sets of wheels drives the frame body 2. A motor is connected to the driving set of wheels. Two or more sets of wheels can of course also be used for driving the frame body if found suitable to certain quay conditions. The frame body 2 can be steered using the driving set of wheels while letting the other sets of wheels rotate freely. The wheels are preferably of solid rubber. This construction allows for movement in all directions along the quay. Alternatively all the sets of wheels or only two sets of wheels could be used for steering the mobile gangway. Preferably the quay area is of asphalt where the bridge will operate. The mobile gangway can be driven at speeds of 0–25 m/min. Lock mechanisms can be arranged at least two sets of wheels to ensure safe parking. The driving speed of the mobile gangway on the quay works on a "dead man" principle and will stop if the control button is released.

The driving of the passenger bridge is performed by an operator using a driving unit. The operator can control the bridge during movement via a radio communication while walking alongside the bridge. The mobile gangway then becomes fully remote operated via a hand held transmitter.

To achieve easy mobility of the mobile passenger bridge 1, the frame body 2 has a suspension arrangement located at two sets of wheels 5, 7, which are diagonally opposite to one another. This allows the mobile bridge 1 to be driven over obstacles as high as approximately 10 cm without causing damage to the mobile bridge 1. This also means that the quay does not have to be modified for the mobile bridge 1 to be used there.

In another embodiment the vertical adjustment could also be incorporated in the frame body to achieve an even greater height range of the gangway.

The passenger bridge 1, according to the invention gives a mobile passenger gangway that can be moved to different places on the quay. A greater flexibility in connecting the gangway to different ships at different docking positions is achieved compared to prior art. It is only the number of the gangway sections that limits the possible height differences, such as 5–15 m, between the ship's door and the passenger disembarkation area. This makes a better use of the quay area than having one long gangway. It becomes possible to use the quay for loading and unloading of cargo ships in between the arrival of the passenger cruisers, as the passenger bridge is mobile and can be moved out of the way. The mobile passenger gangway allows the same gangway to be used at different locations, for example on opposite sides of a pier where otherwise two gangway installations would have to be used. The ability to be able to move the passenger bridge freely without being governed by the use of rails allows for excellent maneuverability. The bridge has unlimited maneuverability in all directions in two dimensions essentially parallel to the quay, that is in an essentially horizontal plane.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A bridge device for passengers boarding and disembarking a ship, comprising:

a frame body which defines an essentially cuboid space, a plurality of wheels attachable to the frame body, the wheels being arranged to support the weight of the device and facilitate maneuverability of the entire device, a gangway structure having only a single gangway structure entrance and a single gangway structure exit and having an odd number of gangway sections, said number being at least three, each of the gangway sections having only a single gangway section entrance and only a single gangway section exit, the gangway structure being disposed substantially within the outer boundaries of the frame body, each of the gangway sections being supported by the frame body and being movable in vertical directions by at least one moving force transmitted through the frame body, each of the gangway sections being both tiltable in two vertical directions and entirely displaceable in two vertical directions, the device defining only a single device entrance and only a single device exit, wherein each of the gangway sections of the gangway structure are vertically movable to accommodate a multitude of device entrance and device exit configurations.

2. A bridge device according to claim 1, wherein the gangway structure comprises a first gangway section, a second gangway section, and a third gangway section, the first gangway section, the second gangway section and the third gangway sections being arranged in three different substantially parallel vertical planes, a first connecting gangway section, and a second connecting gangway section, each of the first and second connecting gangway sections being arranged in separate vertical planes which are substantially perpendicular to the first, second and third gangway sections, the first connecting gangway section being connectable at a first end to an exit end of the first gangway section, and being connectable at a second end to an entrance end of the second gangway section, the second connecting gangway section being connectable at a first end to an exit end of the second gangway section, and being connectable at a second end to an entrance end of the third gangway section, wherein the gangway sections are all individually displaceable and tiltable in two vertical directions and the connecting gangway sections are all individually displaceable in two vertical directions to form a single path originating at a single device entrance and terminating at a single device exit.

3. A bridge device according to claim 2, further comprising flexible accordion-like connecting elements between the gangway sections and the connecting gangway sections, the connecting elements being arranged and constructed to accommodate at connection points differing horizontal angles exhibited by connected sections.

4. A bridge device according to claim 3, further comprising a first telescoping section disposed at an entrance to the first gangway section, which first telescoping section may be extended or retracted to mate with another structure and a second telescoping section disposed at an exit of the third gangway section, which second telescoping section may be extended or retracted to mate with another structure.

5. A bride device according to claim 2, further comprising a telescoping section disposed at an entrance to the first gateway section, which telescoping section may be extended or retracted to mate with another structure.

6. A bridge device according to claim 2, further comprising a telescoping section disposed at an exit of the third gangway section, which telescoping section may be extended or retracted to mate with another structure.

7. The device of claim 2, wherein a hydraulic power unit is arranged for vertically adjusting the gangway sections.

8. The device of claim 2 further comprising a driving unit for driving the passenger bridge remotely.

9. The device of claim 1 further comprising a driving unit for driving the passenger bridge remotely.

10. The bridge device of claim 1, each connecting gangway section being connectable at a first end to an exit end of one gangway section and being connectable at a second end to an entrance end of another gangway section and wherein the gangway sections are all individually displaceable and tiltable in two vertical directions and the connecting gangway sections are all individually displaceable in two vertical directions to form a single path originating at a single device entrance and terminating at a single device exit.

* * * * *